United States Patent [19]

von Bonin

[11] 4,097,385

[45] Jun. 27, 1978

[54] FIRE-PROOFING SEALING ELEMENTS

[75] Inventor: Wulf von Bonin, Leverkusen, Germany

[73] Assignee: Bayer Aktiengesellschaft, Leverkusen, Germany

[21] Appl. No.: 648,850

[22] Filed: Jan. 13, 1976

[30] Foreign Application Priority Data

Jan. 30, 1975 Germany ..... 2503712

[51] Int. Cl.[2] ..... C09K 3/28

[52] U.S. Cl. ..... 428/35; 106/15 FP; 252/8.1

[58] Field of Search ..... 252/8.1; 106/15 FP; 117/138

[56] References Cited

U.S. PATENT DOCUMENTS

| | | | |
|---|---|---|---|
| 3,928,210 | 12/1975 | Peterson | 252/8.1 |
| 3,968,060 | 7/1976 | Vincent | 252/8.1 X |

*Primary Examiner*—Stephen J. Lechert, Jr.

*Attorney, Agent, or Firm*—Burgess, Dinklage & Sprung

[57] ABSTRACT

A fire-proofing sealing material comprising a flexible tube enclosing an aqueous alkali metal silicate in the form of a solution or a gel. The sealing material is placed in an opening such as a joint or crack and, in the event of a fire, the silicate foams and forms a fire-proof seal.

3 Claims, No Drawings

FIRE-PROOFING SEALING ELEMENTS

It is known that fire-proofing elements can be produced from sheeting or even from channel sections consisting of water-containing alkali metal silicates or alkali metal silicate gels which optionally contain reinforcing elements, such as fibers or wire gauze, and which optionally carry surface coatings to prevent the water present from evaporating.

Fire-proofing elements of this kind may be regarded as rigid semi-finished products which, although eminently suitable for a wide range of applications, cannot be used for the production of fire-proofing flexible sealing elements and jointing materials because considerable work is involved in cutting out sealing strips or rings, for example, from these semi-finished products, in addition to which the surfaces of the sealing strips or rings thus formed are unprotected and have to be provided with new surface protection. In addition, when rigid sealing strips of this kind are pressed into position, they tend to break very easily, resulting in further surface damage. Dynamically stressed seals cannot be produced from the material because it is not sufficiently flexible.

The present invention relates to flexible fire-proofing elements, preferably sealing or caulking elements based on alkali metal silicates, which may be heavily deformed, for example wound around pipes, pressed into joints or drawn into grooves, and dynamically stressed without damage or without any reduction in their serviceability.

The fire-proofing sealing elements according to the invention are distinguished by the fact that they consist of a flexible tube filled with a highly viscous aqueous alkali metal silicate solution and/or an aqueous alkali metal silicate gel.

Sealing elements of this kind may readily be wound around pipes, pressed into cavities or drawn into grooves or may be directly used as jointing materials without any need for special, additional manipulation to safeguard their effect.

They may be produced for sale by the meter and are thus particularly economical in use. Folding of the tube ends left after cutting is sufficient to provide adequate protection against evaporation of the water, especially in cases where the ratio of tube length used to cross-section is large, as is normally the case.

In the event of fire, the organic material present in the tube is destroyed and the silicate gel released forms a barrier of high water content and, by foaming, forms an extremely effective protective layer.

The fire-proofing sealing elements according to the invention may be effectively used for improving fire safety in industrial installations, for example refineries in the building sector, in ship building or in the wiring of apparatus.

The flexible tube may have any dimensions. It may have a circular, oval, rectangular and even cresent-shaped or otherwise profiled longitudinal and/or cross section. The tube material should be largely impermeable to water and highly resistant to aqueous alkali, the particular resistance levels required being largely determined by the application envisaged.

It is possible to use, for example, welded, extruded or blown flexible plastic tubing, for example, of rubber, polychloroprene, soft PVC, polyethylene etc., or even flexible tubing of coated fabrics or metal-or fabric-reinforced flexible tubing or a variety of different kinds. The only requirement is that the flexibility should be adequate for assembly at normal working temperatures in the range of from about $-10$ to $+40°$ C. In principle, a lead tube for example would also be suitable.

In principle, any alkali metal silicate may be used as the alkali metal silicate, although it is preferred to use potassium silicate and, for reasons of cost, especially sodium silicate with a molar ratio of $Me_2O$ (Me = alkali metal) to $SiO_2$ of about 1 : 1 to 1 : 4, the range from about 1 : 1.5 to 1 : 3 being preferred.

These silicates are used either in the form of viscous solutions with solids contents of more than about 30% by weight, preferably more than about 40%, or better still are converted into aqueous silicate gels. The solids contents may be up to about 95%, preferably up to about 60% by weight. Conversion into the gel form prevents the silicate solution from running out uncontrollably in the event of damage to the tube or even in the event of fire.

Conversion into the gel form is effected by adding gelling agents whose action is generally based on a reaction with the alkali of the silicate, the reaction being accompanied by the liberation of more highly condensed silicates or polysilicic acids, although it may also have colloidchemical causes.

Substances of this kind are known from the literature. Suitable substances of this type are, for example, $CO_2$, $SO_2$, solid alkali metal silicate itself, sodium silicofluoride, magnesium phosphates, zinc phosphate, formamide, glycerol triacetate, formaldehyde, esters of mono-, di- or trichloroacetic acid, oxalic esters and benzoyl chloride. In addition to propylene glycol-bis-chloroacetic acid esters, pyrocarbonic acid diethyl esters are particularly suitable because, by differentiated addition to the silicate solution, they enable its hardening process to be effectively controlled within short, but not excessively short reaction times.

The quantity in which the gelling agent is added is governed not only by the concentration and composition of the silicate solution, but also by the required consistency of the silicate solution or silicate gel ultimately accommodated in the flexible tube, the transitions between highly viscous solution and gel being fluent. The requisite quantities of the hardening or gelling agent may be readily determined by a preliminary test.

Further additives, for example for improving mixability, include emulsifiers or, for changing consistency, fillers, fibers or even dyes, or additional blowing agents, for example hydrocarbons, sugars or azo compounds. The evaporation or decomposition of these substances under the effect of fire can further improve the foaming of the barriers formed.

The flexible tube provided as the outer skin of the fire-proofing sealing element is best filled with the silicate solution or the mixture thereof with additives such as hardeners, emulsifiers, fillers and, optionally, blowing agents at a stage where this solution or mixture is more thinly liquid than during its actual use. For example, the solution or mixture may be added in thinly liquid hot form, whereas on cooling it subsequently hardens. Alternatively, it may be added before gelation in cases where gelling agents with an adequate pot life are used.

The solution or mixture is best introduced into the flexible tube by, for example, pouring or by introduction under pressure or suction.

The invention is illustrated in the following examples wherein an extruded polyethylene tube with a wall thickness of about 0.5 mm and an internal diameter of about 8 mm is used as tube material for demonstrating the fire-proofing sealing element. It is of course also possible to use any other tube material. The tube material and its geometry are by no means critical features, provided there is adequate flexibility. The flexible tube is filled by drawing the silicate solution or mixture into it under suction.

FILLING 1

An approximately 60% aqueous solution of a sodium silicate ($Na_2O$ : $SiO_2$ approximately 1 : 2 moles) is introduced into the flexible tube at approximately 80° C. The solution which flows freely at that temperature hardens into a viscous mass at room temperature.

FILLING 2

The solution used in Filling 1 is diluted to 45% and stirred with a powdered sodium silicate (composition $Na_2O$ : $SiO_2$ approximately 1 : 3 moles) in a ratio by weight of 1 : 0.5 at a temperature of 15° C. The paste formed is immediately introduced into the flexible tube. The contents of the tube gradually thicken into a stiff, flexible mass.

FILLING 3

100 parts by weight of an approximately 38% aqueous sodium silicate solution ($Na_2O$ : $SiO_2$ approximately 1 : 3 moles) are stirred at 20° C with 1 part by weight of an emulsifier (Na-alkyl sulfonate) and 10 parts of a1,2-propylene glycolbis-chloroacetic acid ester, and the homogenized mixture is immediately introduced into the flexible tube where it hardens into a gel after about 15 minutes.

FILLING 4

100 parts by weight of an approximately 54% sodium silicate solution ($Na_2O$ : $SiO_2$ approximately 1 : 2.2 moles) are stirred with 10 parts of azodiisobutyronitrile and introduced at 45° C into the flexible tube where the mixture hardens into a gel after 2 days at room temperature.

FILLING 5

100 parts by weight of the silicate solution used for Filling 4 are intensively stirred at 30° C with 4 parts by weight of pyrocarbonic acid diethyl ester and immediately introduced into the flexible tube where the material hardens in 10 minutes to form a viscous gel.

FILLING 6

100 parts by weight of the silicate solution used for Filling 4 and 100 parts by weight of the silicate solution used for Filling 3 are intensively stirred with 1 part by weight of Na-alkyl sulfonate and 8 parts of pyrocarbonic acid diethyl ester and introduced into the flexible tube where the mixture hardens into a gel after 10 minutes.

In order to demonstrate the protective effect, a zigzag slot and a meander-form slot approximately 6 mm wide are cut into an approximately 5 mm thick steel plate. The particular filled tube to be tested is pressed as tightly as possible into these slots. The slots filled with the sealing material according to the invention are then exposed on one side of the plate to the flame of a bunsen burner.

In every case, the original slot, following destruction of the tube skin, is filled by a foaming silicate mass which prevents the flame from penetrating.

In another demonstration test, the filled tube is wound around an iron pipe approximately 5 cm in diameter which is then pushed into a corresponding opening in a fire-clay plate so that the opening is sealed off to a certain extent, but not completely. On exposure to a bunsen flame, the opening is completely sealed off by foaming material following destruction of the tube skin so that the flame is unable to penetrate through the opening.

It will be appreciated that the instant specification and claims are set forth by way of illustration and not limitation, and that various modifications and changes may be made without departing from the spirit and scope of the present invention.

What is claimed is:

1. A fire-proofing sealing material comprising a flexible tube impermeable to water, resistant to aqueous alkali and enclosing an aqueous alkali metal silicate in the form of a solution or a gel.

2. A sealing material according to claim 1, wherein the alkali metal silicate is sodium or potassium silicate with a molar ratio of $Na_2O$ or $K_2O$ to $SiO_2$ of about 1:1-4, the aqueous silicate having a solids content of about 30% to about 95% by weight.

3. A sealing material according to claim 1, wherein the alkali metal silicate is sodium silicate with a molar ratio of $Na_2O$ to $SiO_2$ of about 1:1.5–3, the aqueous silicate being in the form of a gel with a solids content of about 40% to about 60% by weight.

* * * * *